US011211732B2

(12) United States Patent
Tuenker et al.

(10) Patent No.: US 11,211,732 B2
(45) Date of Patent: Dec. 28, 2021

(54) PLUG-IN CONNECTOR PART WITH CAULKED CONTACT ELEMENTS AND METHOD FOR PRODUCING SAID PLUG-IN CONNECTOR PART

(71) Applicant: PHOENIX CONTACT GMBH & CO. KG, Blomberg (DE)

(72) Inventors: Manuel Tuenker, Doerentrup (DE); Cord Starke, Blomberg (DE); Valentin Janson, Steinheim (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/610,096

(22) PCT Filed: Jun. 5, 2018

(86) PCT No.: PCT/EP2018/064689
§ 371 (c)(1),
(2) Date: Nov. 1, 2019

(87) PCT Pub. No.: WO2018/228853
PCT Pub. Date: Dec. 20, 2018

(65) Prior Publication Data

US 2020/0083630 A1 Mar. 12, 2020

(30) Foreign Application Priority Data

Jun. 12, 2017 (BE) ..... 2017/5419

(51) Int. Cl.
*H01R 13/424* (2006.01)
*H01R 13/436* (2006.01)
*H01R 13/504* (2006.01)

(52) U.S. Cl.
CPC ..... *H01R 13/424* (2013.01); *H01R 13/4367* (2013.01); *H01R 13/5045* (2013.01)

(58) Field of Classification Search
None
See application file for complete search history.

(56) References Cited

U.S. PATENT DOCUMENTS 2,949,642 A * 8/1960 Lieberman ..... H01R 43/24 264/274
3,678,444 A * 7/1972 Stevens ..... H01R 24/52 439/551

(Continued)

FOREIGN PATENT DOCUMENTS

CN 105552649 A 5/2016
CN 205319407 U 6/2016

(Continued)

*Primary Examiner* — Oscar C Jimenez
(74) *Attorney, Agent, or Firm* — Leydig, Voit & Mayer, Ltd.

(57) ABSTRACT

A plug-in connector part for plug-in connection to a mating plug-in connector part includes: a housing part which has at least one receiving opening and at least one electrical contact element disposed in the at least one receiving opening; and a staking element arranged on the housing part and which in a preassembled state of the connector part is movable along a staking direction to the housing part and by moving in the staking direction is brought into interaction with a staking section of the housing part so that, in an assembled state, the at least one electrical contact element is staked to the housing part.

8 Claims, 8 Drawing Sheets

(56) References Cited

U.S. PATENT DOCUMENTS

| | | | | | |
|---|---|---|---|---|---|
| 4,431,255 | A * | 2/1984 | Banning | H01R 9/0521 | 439/578 |
| 4,688,876 | A * | 8/1987 | Morelli | H01R 24/40 | 439/578 |
| 4,758,182 | A * | 7/1988 | Anbo | H01R 13/4368 | 439/271 |
| 6,000,966 | A * | 12/1999 | Dechanteloup | H01R 13/5208 | 439/595 |
| 6,106,340 | A * | 8/2000 | Myer | H01R 13/4367 | 439/595 |
| 2016/0164223 | A1* | 6/2016 | Zebhauser | H01R 24/28 | 439/660 |
| 2017/0214191 | A1* | 7/2017 | Lane | H01R 43/16 | |
| 2019/0165495 | A1* | 5/2019 | Starke | H01R 13/6583 | |
| 2019/0305533 | A1* | 10/2019 | Krause | H02G 3/083 | |

FOREIGN PATENT DOCUMENTS

| | | | |
|---|---|---|---|
| DE | 1490159 | A1 | 12/1968 |
| DE | 102010063303 | A1 | 6/2012 |
| DE | 102013222941 | A1 | 5/2015 |
| DE | 202015103779 | U1 | 10/2016 |
| EP | 0954060 | A2 | 11/1999 |
| EP | 2302743 | A1 | 3/2011 |
| GB | 1047326 | A | 11/1966 |
| WO | WO 9528021 | A1 | 10/1995 |

* cited by examiner

PLUG-IN CONNECTOR PART WITH CAULKED CONTACT ELEMENTS AND METHOD FOR PRODUCING SAID PLUG-IN CONNECTOR PART

CROSS-REFERENCE TO PRIOR APPLICATIONS

This application is a U.S. National Phase application under 35 U.S.C. § 371 of International Application No. PCT/EP2018/064689, filed on Jun. 5, 2018, and claims benefit to Belgian Patent Application No. BE 2017/5419, filed on Jun. 12, 2017. The International Application was published in German on Dec. 20, 2018 as WO/2018/228853 under PCT Article 21(2).

FIELD

The invention relates to a plug-in connector part for connecting to a mating plug-in connector part, and to a method for producing a plug-in connector part for connecting to a mating plug-in connector part.

BACKGROUND

Such a plug-in connector part, which can take the form of, for example, a round plug-in connector part, has a housing part which comprises at least one receiving opening. At least one electrical contact element is arranged in the at least one receiving opening, via which the plug-in connector part can electrically contact the associated mating plug-in connector part.

In the production of such a plug-in connector part, contact elements must be fixedly arranged on the housing part. The contact elements are to be fixed on the housing part positionally accurately while observing close tolerances in such a way that the contact elements are fixedly held on the housing part during use and that forces acting during plugging-in, for example, do not lead to a loosening of the contact elements.

In order to assemble a plug-in connector part, cores of an electrical lead are to be connected to the contact elements. This is done, for example, by means of crimping connections via which the cores are connected to respectively associated contact elements, in order to then fix to the housing part the contact elements together with the cores connected thereto.

Different methods for fixing the contact elements to a housing part are common nowadays. For example, the contact elements can be pressed into the housing part. Alternatively, the contact elements can be latched with the housing part and in this way be connected in an interlocking manner to the housing part.

In general, there is a need to fix contact elements to a housing part in a reliable, simple and positionally accurate manner, in particular also in the case of such plug-in connector parts that only provide a small installation space for the contact elements and therefore require compliance with close tolerances. Reliable fixing is also to be possible in particular in the case of cores with a large conductor cross-section and a resultant great stiffness and load on the contact elements.

In a plug-in connector known from DE 20 2015 103 779 U1, flat contacts are fixed by staking into a housing made of insulating material.

In a plug-in connector known from DE 10 2013 222 941 A1, a contact element is staked into a housing by pressing in press-fit pins.

In a plug-in connector known from DE 10 2010 063 303 A1, a contact element is connected to a housing by heat staking in that the housing is staked at a melting location.

SUMMARY

In an embodiment, the present invention provides a plug-in connector part for plug-in connection to a mating plug-in connector part, comprising: a housing part which has at least one receiving opening and at least one electrical contact element disposed in the at least one receiving opening; and a staking element arranged on the housing part and which in a preassembled state of the connector part is movable along a staking direction to the housing part and by moving in the staking direction is brought into interaction with a staking section of the housing part so that, in an assembled state, the at least one electrical contact element is staked to the housing part.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
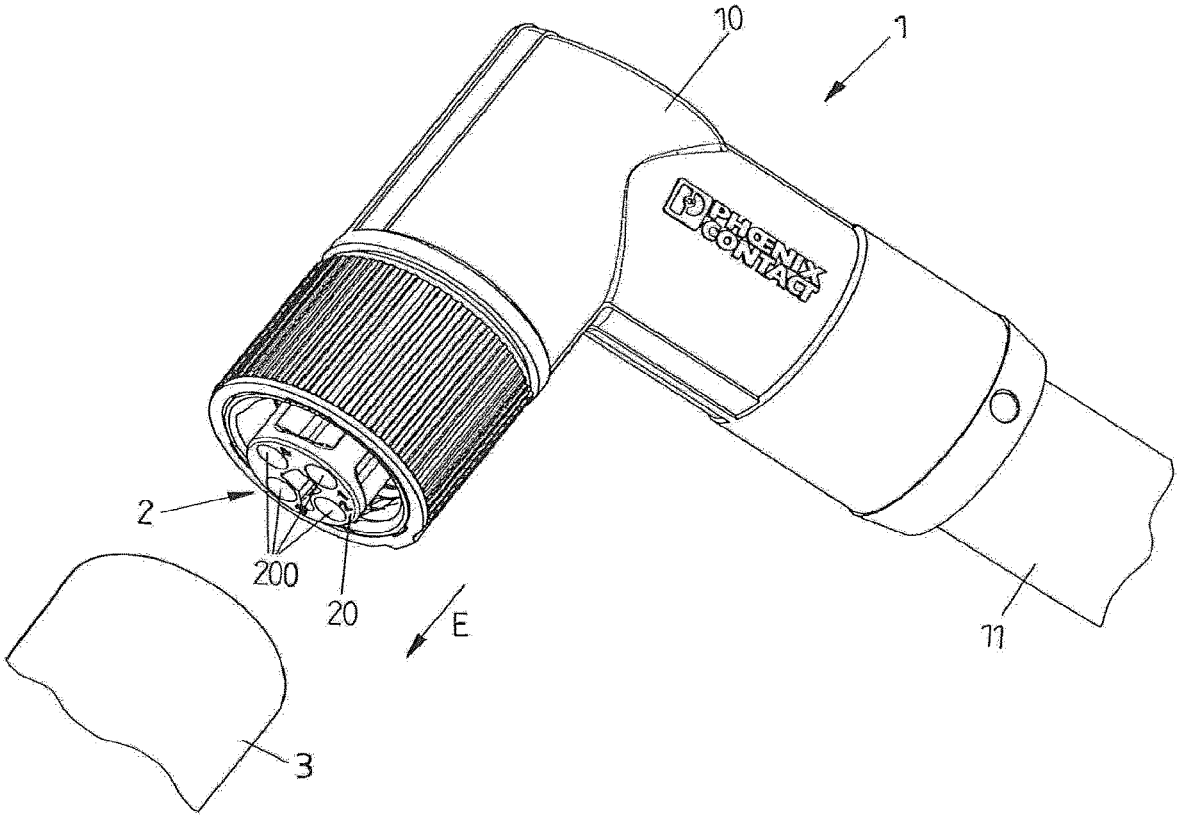
FIG. 1 a view of an exemplary embodiment of a plug-in connector part.

In an embodiment, the present invention provides a plug-in connector part and a method for producing a plug-in connector part, which enable assembly with simple handling as well as reliable and positionally accurate holding of contact elements on a housing part.

Accordingly, the plug-in connector part comprises a staking element which is arranged on the housing part and which, in a preassembled state of the plug-in connector part, can be moved along a staking direction to the housing part and can be brought into interaction with a staking section of the housing part by moving in the staking direction so that, in an assembled state, the at least one contact element is staked to the housing part.

One or more contact elements are thus fastened by staking to a housing part, for example an insulating body made of an electrically insulating material, in particular a plastic material. This makes it possible to first attach the contact elements without force to the housing part by inserting the contact elements into the receiving openings provided for this purpose on the housing part. The contact elements are then staked to the housing part and thereby fixed to the housing part so that the contact elements are fixed loadably to the housing part.

Since the contact elements can initially be inserted in a force-free manner into the receiving openings provided for this purpose on the housing part, the contact elements can first be connected to the cores of the lead and then be attached to the housing part together with the cores. By staking, the fixing of the contact elements to the housing part can then take place in one work step covering all contact elements, which in particular also makes it possible to handle comparatively rigid cores with a large conductor cross-section while nevertheless keeping the contact elements firmly fixed to the housing part and complying with close tolerances.

The staking is effected by means of a staking element which is arranged on the housing part. In a preassembled state, the contact elements can be inserted substantially without force into the receiving openings on the housing part. The staking is then effected by moving the staking element to the housing part in a staking direction, as a result of which the staking element interacts with a staking section on the housing part and thereby stakes the contact elements to the housing part. The staking thus takes place in a defined manner uniformly for all contact elements using the staking element which acts on the housing part for staking the contact elements.

The plug-in connector part can be designed, for example, as a round plug-in connector part with an at least approximately round cross-section. Accordingly, the housing part, which is, for example, part of a contact insert of the plug-in connector part, can have a cylindrical basic shape with an approximately round cross-section. A plurality of receiving openings in which the contact elements are to be accommodated may be arranged in the housing part wherein the contact elements can be grouped on the housing part, for example, in such a way that they are arranged along a circle.

In one embodiment, in the preassembled state of the plug-in connector part, the staking section can, for example, project outwardly from a lateral surface of the housing part. By moving the staking element relative to the housing part, the staking element acts on the staking section and plastically deforms the latter, for example, in such a way that material is pressed into the region of a receiving opening in which a contact element is placed so that the contact element is fixed in the receiving opening in an interlocking and staking manner. Plastic deformation at the housing part thus creates an interlocking and staking connection of one or more contact elements to the housing part, by means of which connection the one or more contact elements are fixed to the housing part in a positionally accurate manner.

In one embodiment, the staking element can take the form of, for example, a ring element which surrounds the housing part circumferentially. The ring element thus surrounds the housing part in the manner of a sleeve and can be moved to the housing part in order to act on the at least one staking section of the housing part and thereby stake to the housing part the contact elements arranged on the housing part. By using a uniform staking element for staking a plurality of contact elements to the housing part, a simplicity of handling is obtained with a defined fixing of the contact elements on the housing part.

While the housing part is preferably made of an electrically insulating material and thus provides an insulating body on which the contact elements are arranged and electrically insulated from one another, the staking element in one embodiment can be manufactured, for example, from an electrically conductive material. For example, a shielding conductor of a lead connected to the plug-in connector part can be arranged on the staking element so that the shielding conductor is electrically connected to the staking element and can be electrically contacted via the staking element to an associated mating plug-in connector part. The staking element thus not only serves for fixing the contact elements to the housing part during assembly but also assumes an electrical function for contacting a shielding conductor at a ground potential.

In one embodiment, a plug section is formed on the housing part and serves for the plug-in connection to a mating plug-in connector part and has, for example, one or more contact openings which are aligned with the receiving openings of the housing part. The contact elements rest in the contact openings in such a way that an electrical contacting of the contact elements to associated mating contact elements of the mating plug-in connector part can be established by inserting the plug section into the associated mating plug-in connector part. The plug section can also have a substantially cylindrical basic shape. On the other hand, a plug-in opening which is cylindrical in its basic shape can, for example, be formed in the manner of a socket on the mating plug-in connector part.

The contact element may take different forms. For example, the contact element can take the form of a contact socket into which a mating contact element in the form of a contact pin can be inserted. Alternatively, the contact element can also take the form of a contact pin which can be inserted into a contact socket.

The contact element can take the form of a turned part, for example. The contact element is thus made from a solid body by turning, wherein contact lamellae (which are elastically deformable to a certain degree in order to allow insertion of a contact pin into a contact opening formed by the contact lamellae) can be separated from one another by sawing.

Alternatively, the contact element can also be designed as a rolled contact. Such a contact element consists of a stamped metal sheet which is rolled up to provide a socket geometry.

In each case, an electrical core can be connected, for example, by crimping to the contact element.

The housing part together with the staking element can, for example, be a component of a contact insert which is accommodated in a housing of the plug-in connector part. The contact insert, together with the cores connected to the contact elements, is to be arranged as a unit in the housing of the plug-in connector part so that a simple assembly is possible when using quite different contact inserts with very different housings to provide plug-in connector parts with entirely different plug-in faces.

In an embodiment, the present invention provides a method for producing a plug-in connector part for plug-in connection to a mating plug-in connector part, in which at least one electrical contact element is arranged in at least one receiving opening of a housing part of the plug-in connector part. In the method, it is provided that for staking the at least one contact element to the housing part, a staking element arranged on the housing part is moved in a staking direction to the housing part and thereby brought into interaction with a staking section of the housing part so that the at least one contact element is staked to the housing part in an assembled state.

The advantages and advantageous embodiments described above for the plug-in connector part also apply analogously to the method so that reference is to be made to the above statements in this regard.

FIGS. 1 to 5A, 5B show a first exemplary embodiment of a plug-in connector part 1 which, as schematically illustrated in FIG. 1, can be brought into engagement in a plugged manner with an associated mating plug-in connector part 3 in a plug-in direction E in order to establish an electrical contact between the plug-in connector part 1 and the mating plug-in connector part 3.

The plug-in connector part 1 is designed as a so-called circular connector with a housing 10 which is at least approximately round in cross-section. Connected to the housing 10 is a lead 11 with cores 110 guided therein, which are electrically connected by contact elements 23 to a housing part 21 of a contact insert 2 which forms a plug section 20, as is illustrated, for example, in FIG. 4B.

Figure 4A:
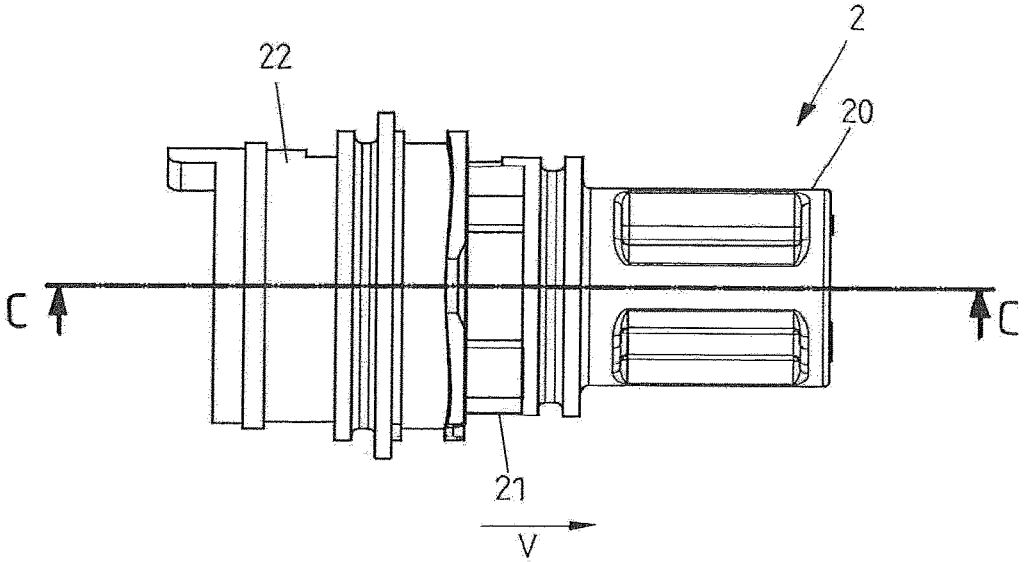
FIG. 4A a side view of the contact insert in the preassembled state.
Figure 4B:
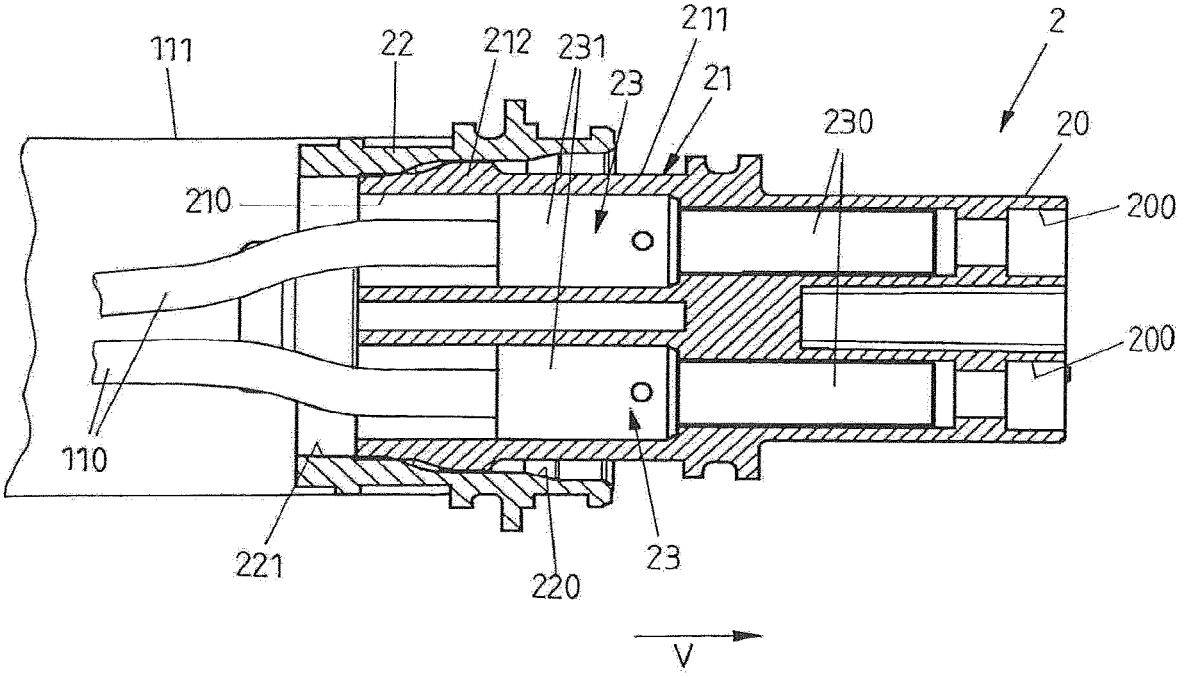
FIG. 4B a sectional view along line C-C shown in FIG. 4A.
Figure 5A:
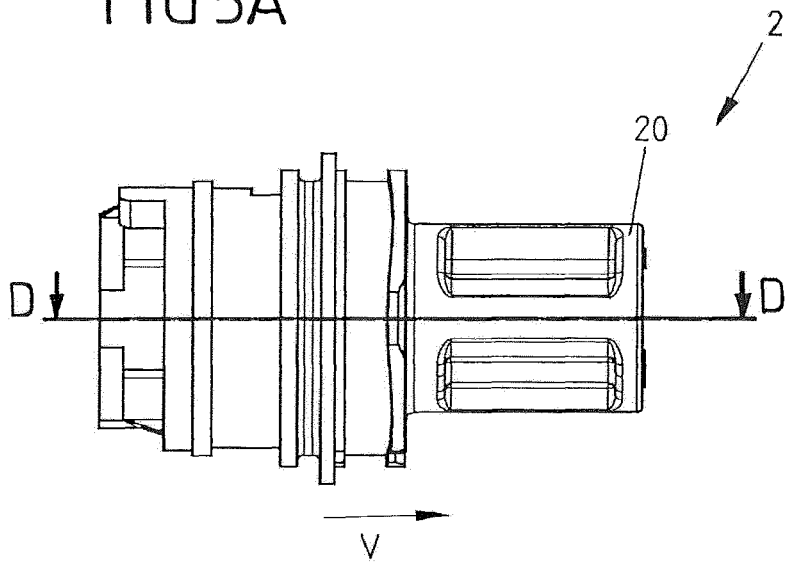
FIG. 5A a side view of the plug-in connector part in the assembled state.
Figure 5B:
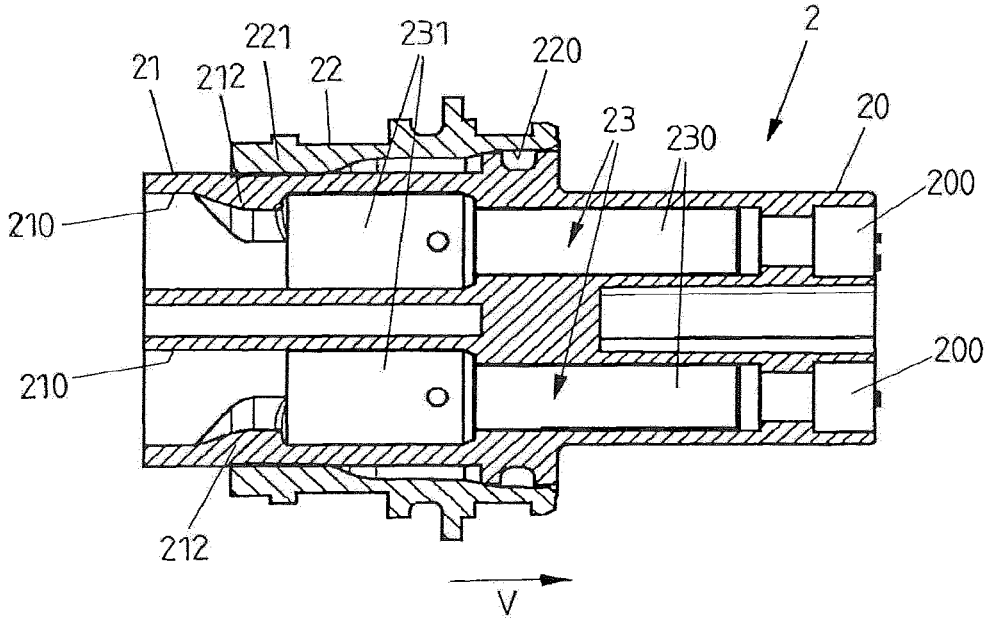
FIG. 5B a sectional view along line D-D shown in FIG. 5A.
Figure 6:
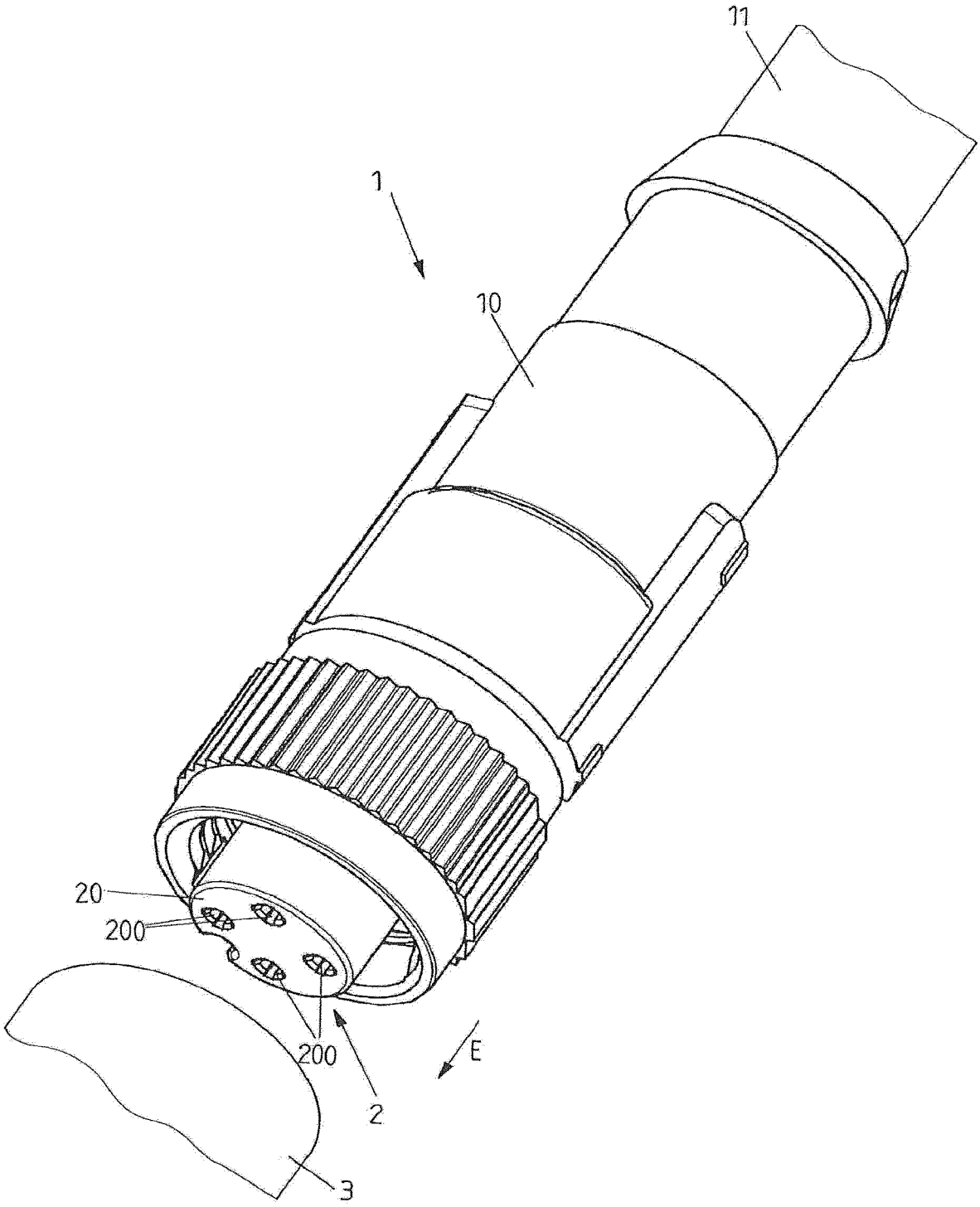
FIG. 6 a view of another exemplary embodiment of a plug-in connector part.
Figure 7:
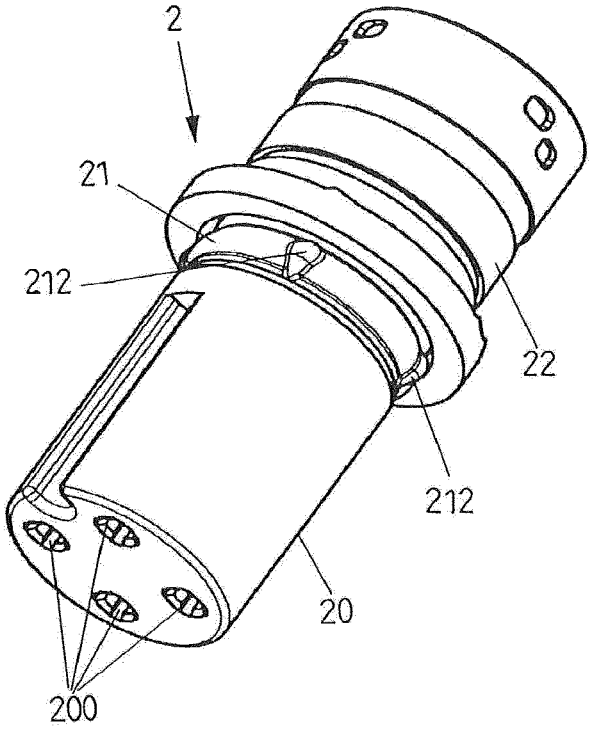
FIG. 7 a view of a contact insert of the plug-in connector part in a preassembled state.
Figure 8:
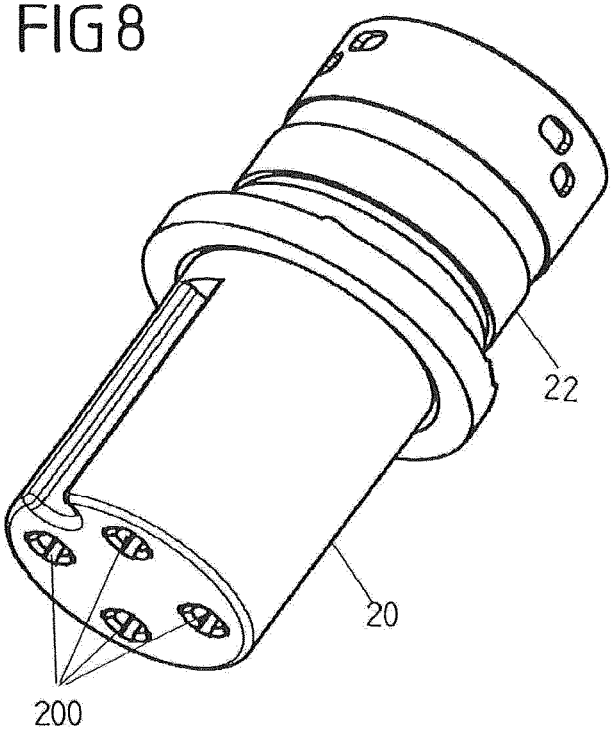
FIG. 8 a view of the contact insert in an assembled state.

As can be seen from FIGS. 4B and 5B, the contact elements 23 are accommodated in receiving openings 210 of the housing part 21. In this exemplary embodiment, the contact elements 23 take the form of turned parts and are inserted into the receiving openings 210 of the housing part 21 in such a way that the contact elements 23 with socket-shaped contact sections 230 lie in contact openings 200 of the plug section 20 and can thus via the contact openings 200 be engaged with associated contact pins of the mating plug-in connector part 3 in a plugging and electrically contacting manner.

Connecting sections 231, which are connected in an electrically contacting manner to cores 110 of the lead 11, for example by crimping, connect to the contact sections 230 to the rear of the contact openings 200.

Figure 2:
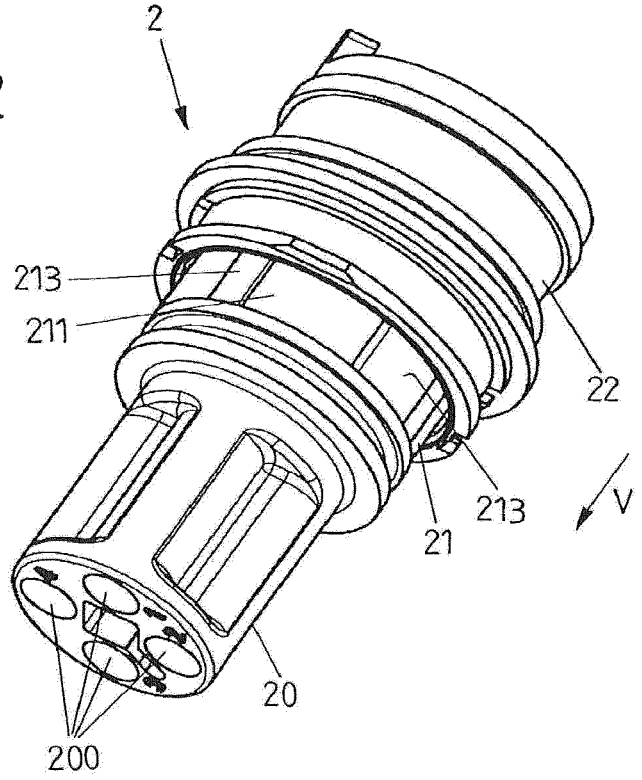
FIG. 2 a view of a contact insert of the plug-in connector part in a preassembled state.

The contact elements 23 which are arranged in a distributed manner along a circle on the housing part 21, as shown, for example, in FIG. 2 (see the arrangement of the contact openings 200 on the end face of the plug section 20) are fixed in the housing part 21 by staking. For this purpose, a staking element 22 in the form of a ring element is arranged on the housing part 21 and encloses the housing part 21 in an annular manner and can be moved to the housing part 21 from a preassembled state (FIG. 2) into an assembled state (FIG. 3) in order to fix the contact elements 23 within the receiving openings 210 in the assembled state.

In the preassembled state, illustrated in FIGS. 2 and 4A and 4B, the contact elements 23 can be inserted substantially without force into the associated receiving openings 210 of the housing part 21 until the connecting sections 231 have been guided to abutment in the receiving openings 210 and in the housing part 21 assume the position shown in FIG. 4B. In this preassembled state, the staking element 22 assumes a rearward position on the housing part 21 and, in particular with an end section 221, does not interact with staking sections 212 on the outside of the housing part 21, as can be seen from FIG. 4B.

Figure 3:
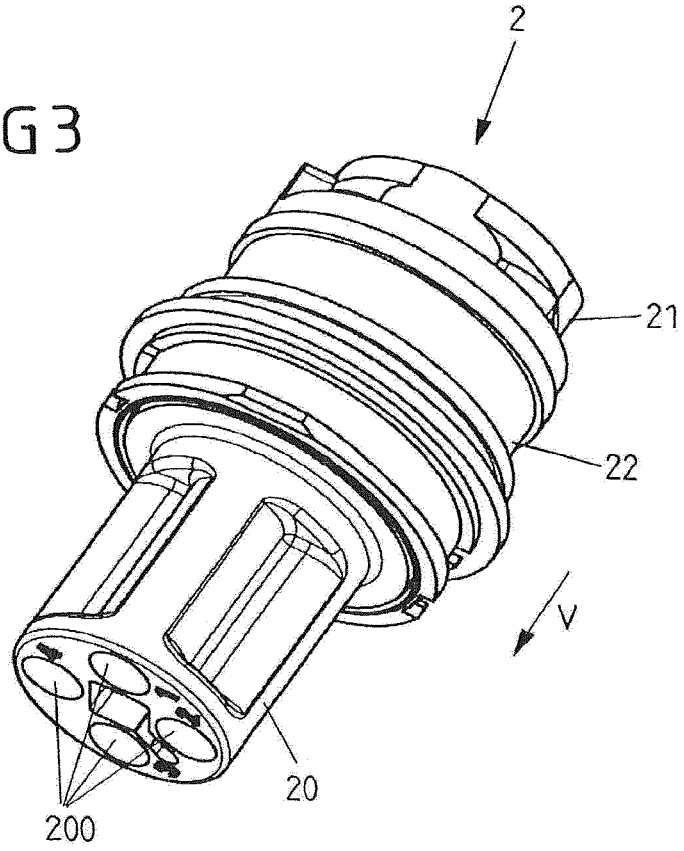
FIG. 3 a view of the contact insert in an assembled state.

When the contact elements 23 have been inserted into the receiving opening 210 on the housing part 21, the staking element 22 is displaced on the housing part 21 in a staking direction V, as can be seen in the transition from FIG. 2 to FIG. 3. As a result, the end section 221, having a smaller inner diameter than other sections of the cylinder opening 220 of the staking element 22, rests on the staking sections 212 on the outside of an outer lateral surface 211 of the housing part 21 so that the housing part 21 is plastically deformed in the region of the staking sections 112 and material is pressed inwardly into the region of the receiving openings 210, as can be seen from FIG. 5B.

Since material thus projects into the receiving openings 210 behind the connecting sections 231 of the contact elements 23 in the assembled state shown in FIG. 3 and FIGS. 5A, 5B, the contact elements 23 within the receiving openings 210 are fixed in an interlocking and staking manner and are thus fixed in the housing part 21.

As can be seen from FIG. 2, the outer lateral surface 211 of the housing part 21 can be interrupted by recesses 213. In this case, the staking sections 212 are arranged on the outer lateral surface 211 in such a way that they are each assigned to a receiving opening 210 so that material can be pressed into the region of the receiving openings 210 by plastic deformation at the plug sections 211.

Prior to staking, the cores 110 of the lead 11 are connected to the contact elements 23. The contact elements 23 can then be attached together to the housing part 21 and be staked together to the housing part 21 by adjustment of the staking element 22.

While the housing part 21 is made of an electrically insulating material, in particular a plastic material, the staking element 22 in the form of the ring element surrounding the housing part 21 is preferably made of an electrically conductive material, in particular a metal material. According to a further aspect, the staking element 22 can, for example, be electrically connected to a shielding conductor 111, as illustrated in FIG. 4B, so that the staking element 22 also assumes an electrical function of the plug-in connector part 1 beyond its staking function and ensures an electrical contacting of the shielding conductor 111 of the lead 11, said conductor being at a ground potential.

If the contact insert 2 has been assembled with the contact elements 23 and the cores 110 connected thereto, and possibly by connecting the shielding conductor 111 to the staking element 22, the contact insert 2 can be inserted into the housing 10 of the plug-in connector part 1 in order to complete the assembly of the plug-in connector part 1 in this way.

The contact elements 23 being staked to the housing part 21 results in a simple assembly which can be done without the use of external tools. For staking the contact elements 23 to the housing part 21, only the staking element 22 needs to be shifted on the housing part 21. This results in the contact elements 23 being held firmly within the housing part 21 with possible compliance even with close tolerances.

While the contact elements 23 take the form of turned parts in the exemplary embodiment shown in FIGS. 1 to 5A, 5B, the contact elements 23 in a further exemplary embodiment shown in FIGS. 6 to 10A, 10B are produced as so-called rolled contacts from a rolled stamped sheet.

Again, a staking element 22 is arranged on a housing part 21 of a contact insert 2 of the plug-in connector part 1 and takes the form of a ring element and encloses the housing part 21 annularly. The staking element 22 can be moved from a preassembled state (FIG. 7) into an assembled state (FIG. 8) in order to stake the contact elements 23 into receiving openings 210 of the housing part 21 in this way.

Figure 9A:
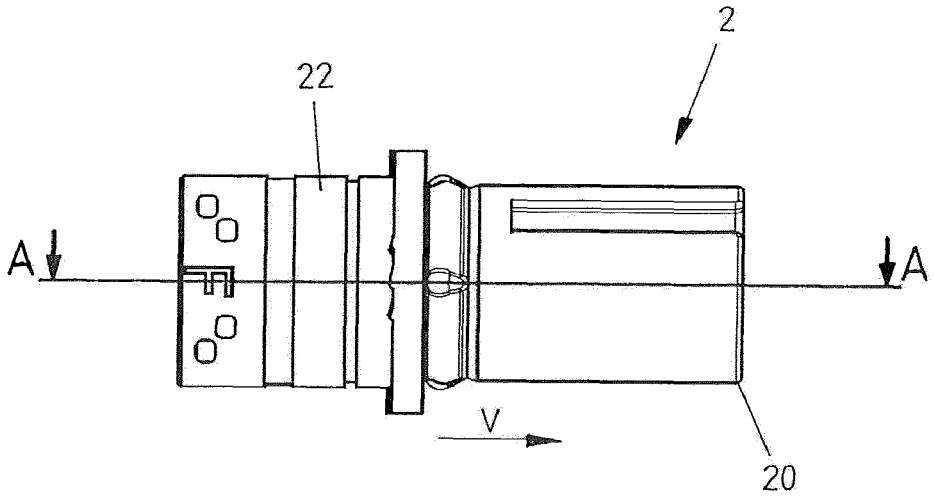
FIG. 9A a side view of the contact insert in the preassembled state.
Figure 9B:
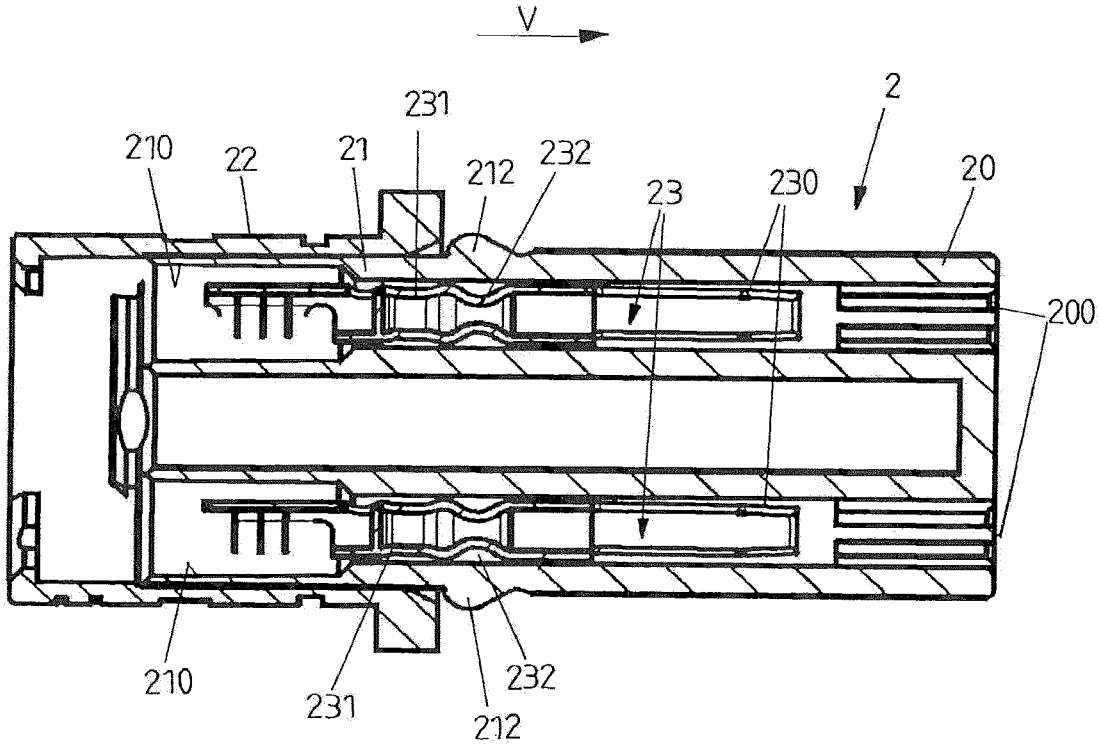
FIG. 9B a sectional view along line A-A shown in FIG. 9A.
Figure 10A:
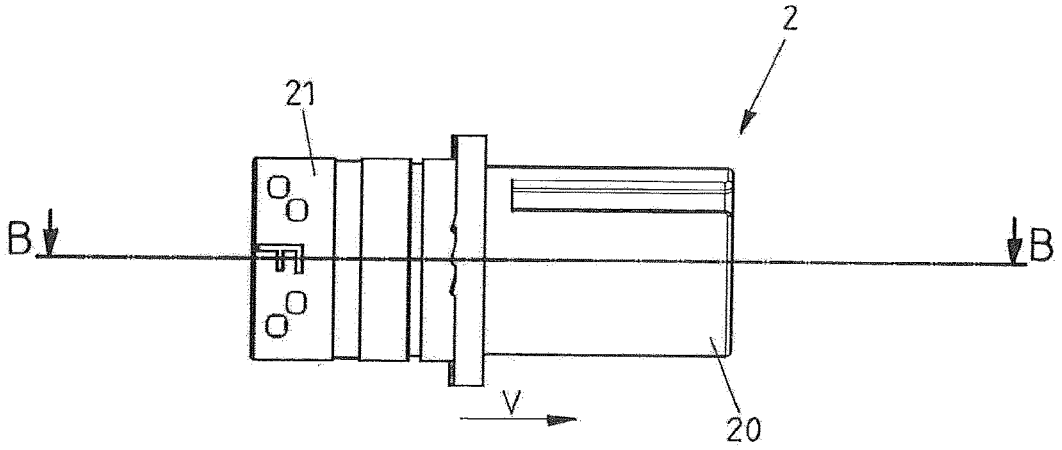
FIG. 10A a side view of the contact insert in an assembled state.
Figure 10B:
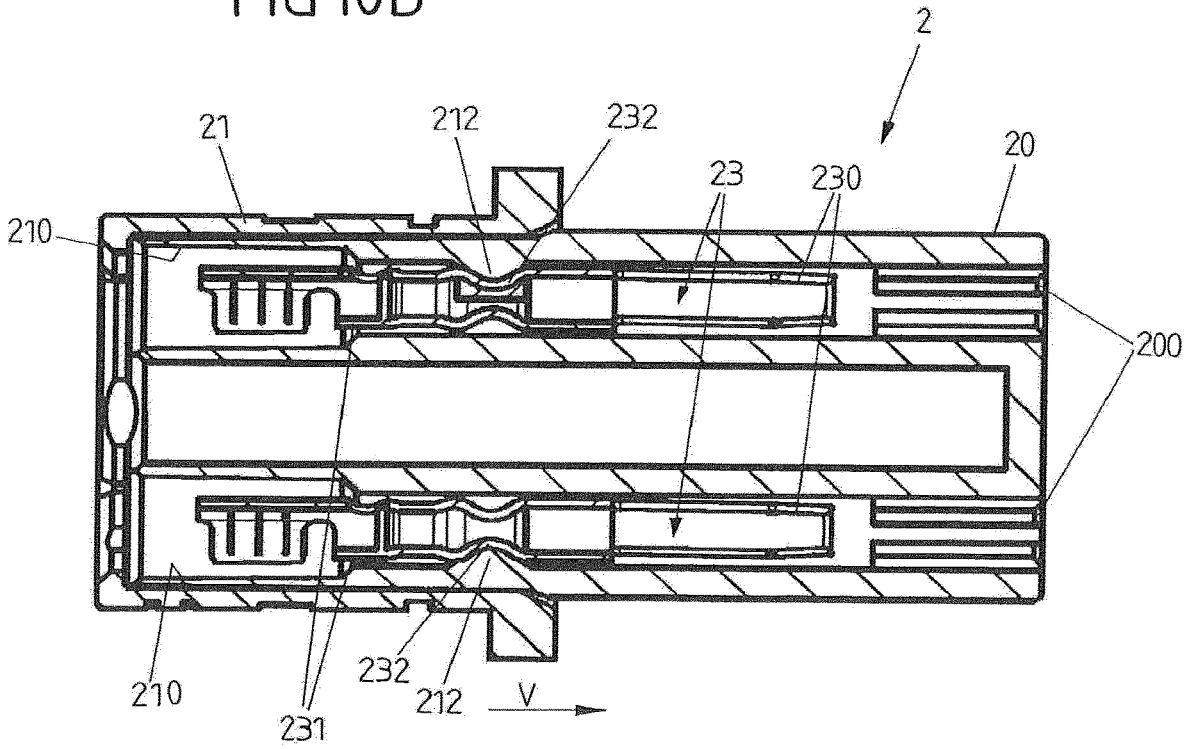
FIG. 10B a sectional view along line B-B shown in FIG. 10A.

FIGS. 9A, 9B show the contact insert 2 in the preassembled state. In contrast, FIGS. 10A, 10B show the contact insert 2 in the assembled state. By adjusting the staking element 22 in the staking direction V, the staking element 22 acts on staking sections 212 on the outside of the housing part 21 and thereby presses material into the receiving openings 210 so that material engages in fixing sections 232 in the form of notches in the contact elements 23, as can be seen from FIG. 10B. In this way, the contact elements 23 are fixed in an interlocking and a staking manner within the receiving openings 210 and are thus fixed in the housing part 21.

Again, cores can be connected to connecting sections 231 of the contact elements 23 by crimping. The cores are connected before the contact elements 23 are staked in the housing part 21 so that the contact elements 23 on the cores can be inserted into the receiving openings 210 in the housing part 21.

In the exemplary embodiment shown in FIGS. 6 to 10A, 10B, the plug-in connector part 1 extends in a straight line. In contrast, in the exemplary embodiment shown in FIGS. 1 to 5A, 5B, the plug-in connector part 1 is angled. However, this is in each case only to be understood as an example and is in no way limiting for the function of the plug-in connector part 1.

The idea underlying the invention is not limited to the exemplary embodiments described above but can also be realized in a completely different manner.

The staking of the contact elements in the housing part can be effected by cold staking alone by adjustment of the staking element. However, heat staking is also conceivable and possible, in which the housing part is at least locally heated in advance.

The staking element is adjustable relative to the housing part. In this case, the staking element does not necessarily take the form of a ring element but can also have a different shape and can in particular also be movable in a different way, for example rotatably on the housing part.

In addition, the plug-in connector part is not necessarily designed as a circular connector but can also have a different shape.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Plug-in connector part
10 Housing
11 Lead
110 Core
111 Shielding conductor
2 Contact insert
20 Plug section
200 Contact opening
21 Housing part
210 Receiving opening
211 Outer lateral surface
212 Staking section
213 Recess
22 Staking element (ring element)
220 Cylinder opening
221 End section
23 Contact element
230 Contact section
231 Connecting section
232 Fixing section (notch)
3 Mating plug-in connector part
V Staking direction

The invention claimed is:

1. A method for producing a plug-in connector part for plug-in connection with a mating plug-in connector part, comprising:

arranging at least one electrical contact element in at least one receiving opening of a housing part of the plug-in connector part;

for staking the at least one electrical contact element to the housing part, moving a staking element arranged on the housing part in a staking direction to the housing part so as to bring the staking element into interaction with a staking section of the housing part so that, in an assembled state, the at least one electrical contact element is staked to the housing part, wherein by movement of the staking element in the staking direction, the housing part is plastically deformable in a region of the staking section in order to connect the at least one electrical contact element to the housing part, and wherein the housing part comprises an electrically insulating material and the staking element comprises an electrically conductive material.

2. A plug-in connector part for plug-in connection to a mating plug-in connector part, comprising:

a housing part which has at least one receiving opening and at least one electrical contact element disposed in the at least one receiving opening; and a staking element arranged on the housing part and which in a preassembled state of the connector part is movable along a staking direction to the housing part and by moving in the staking direction is brought into interaction with a staking section of the housing part so that, in an assembled state, the at least one electrical contact element is staked to the housing part, wherein by movement of the staking element in the staking direction, the housing part is plastically deformable in a region of the staking section in order to connect the at least one electrical contact element to the housing part, and wherein the housing part comprises an electrically insulating material and the staking element comprises an electrically conductive material.

3. The plug-in connector part according to claim 2, wherein the housing part has a cylindrical basic shape.

4. The plug-in connector part according to claim 2, wherein, in the preassembled state of the plug-in connector part, the staking section projects from a lateral surface of the housing part.

5. The plug-in connector part according to claim 2, wherein the staking element comprises a ring element which surrounds the housing part circumferentially.

6. The plug-in connector part according to claim 2, further comprising a plug section for plug-in connection to the mating plug-in connector part arranged on the housing part, the plug section having at least one contact opening which is aligned with the at least one receiving opening and in which a contact section of the at least one electrical contact element lies.

7. The plug-in connector part according to claim 2, wherein the at least one electrical contact element comprises a turned part or a rolled contact.

8. The plug-in connector part according to claim 2, wherein the housing part together with the staking element forms a contact insert which is accommodated in a housing of the plug-in connector part.

* * * * *